US006830037B1

(12) United States Patent
Braun et al.

(10) Patent No.: US 6,830,037 B1
(45) Date of Patent: Dec. 14, 2004

(54) ANTI-ROTATION FUEL INJECTOR CLIP

(75) Inventors: Charles W. Braun, Livonia, NY (US); John H. Delaney, Scottsville, NY (US); David W. Rogers, Henrietta, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/765,376

(22) Filed: Jan. 27, 2004

(51) Int. Cl.[7] ..... F02M 37/04
(52) U.S. Cl. ..... 123/470
(58) Field of Search ..... 123/456, 470, 123/472

(56) References Cited

U.S. PATENT DOCUMENTS 5,074,269 A * 12/1991 Herbon et al. ..... 123/456
5,803,052 A * 9/1998 Lorraine et al. ..... 123/470
6,276,339 B1 * 8/2001 Shebert et al. ..... 123/470
6,481,420 B1 * 11/2002 Panasuk et al. ..... 123/470
6,637,411 B2 * 10/2003 Makiyama ..... 123/470
6,705,292 B2 * 3/2004 Bugos ..... 123/470

* cited by examiner

*Primary Examiner*—Thomas Moulis
(74) *Attorney, Agent, or Firm*—Jimmy L. Funke

(57) ABSTRACT

An anti-rotation clip for joining a fuel injector body to a fuel rail socket. A C-shaped base is formed to slide into an annular groove in the injector body. A pair of tangs extend from the base to straddle a rib on the injector body to prevent rotation between the clip and the injector. Opposed sidewalls extending from the base include windows for receiving a radial flange of the fuel rail socket to correctly position the fuel injector axially within the socket. Each window is divided by a locking bar for reception in a notch in the socket flange to prevent rotation between the clip and the socket. The radial positions of the injector rib and flange notch are selected such that the injector will be properly oriented with respect to the engine after installation therein.

7 Claims, 4 Drawing Sheets

ANTI-ROTATION FUEL INJECTOR CLIP

TECHNICAL FIELD

The present invention relates to internal combustion engines; more particularly, to devices for securing fuel injectors into fuel distribution rails; and most particularly, to a clip for providing such securing and also preventing subsequent rotation of the fuel injector with respect to the fuel distribution rail and engine.

BACKGROUND OF THE INVENTION

Means for attaching and securing of fuel injectors to fuel distribution rails of internal combustion engines is well known. Typically, a formed metal clip is employed to urge the body of a fuel injector into a cup-shaped socket element previously pressed into a port in the fuel rail, the injector body having means such as an O-ring for sealing against the inner surface of the socket. See, for example, U.S. Pat. Nos. 6,276,339 and 6,637,411.

In 4-valve engines, the relationship between the fuel injector spray pattern and the intake valves in the valve port can be critical and requires a specific orientation of the fuel injector tip to the intake valves. In such engines, the fuel injector body must be specifically oriented rotationally with respect to the rail and socket, and be prevented from rotation during its working lifetime. The fuel rail pre-assembly including fuel injectors must resist rotation of the injectors while the pre-assembly is being shipped, while it is being installed into an engine, during engine installation into a vehicle, and at any time an injector of the fuel rail is bumped during engine maintenance as well as while being subjected to "in use" forces.

U.S. Pat. No. 6,481,420 discloses a clip having anti-rotation capabilities. The clip has a flat, C-shaped base that is formed to slide into, and be retained in, an annular groove in the injector body. A plurality of upstanding tangs extend from the base to receive and substantially surround an annular flange on a fuel rail socket. An alignment protrusion is also provided on the clip to interface with a notch on the annular flange to prevent axial rotation of the fuel injector relative to the fuel rail socket (assuming that the socket has been correctly oriented during its installation into the fuel rail).

The alignment protrusion of this device can provide resistance to relatively low rotational forces on the fuel injector; however, progressively higher torque can deform the clip base and twist the protrusion out of engagement with the socket flange. At least one automotive manufacturer has now increased the minimum torque resistance of such a joint from 1.5 Nm to 3.0 Nm, and, because of the bending moment placed on the base of the alignment protrusion when the injector is axially twisted, the above structure will fail at such elevated torque levels.

U.S. Pat. No. 5,803,052 also discloses a clip having anti-rotation capabilities. The clip has a flat, C-shaped base that is formed to slide into, and be retained in, an annular groove in the injector body. Opposed sidewalls extend from the base and include horizontal slots for capturing a radial flange on a fuel rail socket to position and retain the injector body axially within the cup. A third sidewall connecting the opposed sidewall also extends from the base and includes a window for receiving radial tangs on both the fuel injector body and the cup flange, thereby locking the rotational relationship between the body and flange.

This configuration may be capable of resisting a rotational torque greater than the clip disclosed in U.S. Pat. No. 5,803,052. However, a drawback of this configuration is that the clip cannot be installed until after the injector has been inserted into the socket, whereas in some manufacturing processes it would be desirable to install an anti-rotation clip onto either the fuel injector or the socket prior to their being joined.

It is a principal object of the present invention to provide means for joining a fuel injector into a fuel rail to prevent rotation of the fuel injector at elevated torque levels.

It is a further object of the invention to provide such means including a joining clip wherein the clip may be installed onto the fuel injector body prior to insertion of the fuel injector into the fuel rail socket.

SUMMARY OF THE INVENTION

Briefly described, an anti-rotation clip for joining a fuel injector body to a fuel rail socket includes a flat, C-shaped base that is formed to slide into, and be retained in, an annular groove in the injector body. A pair of curved tangs extend from the base to straddle a longitudinal rib on the injector body to prevent rotation between the clip and the injector. Opposed sidewalls extend from the base in the opposite direction. A window is formed in each sidewall for receiving a radial flange of a fuel rail socket to correctly position the fuel injector axially within the socket. Each window is divided by a locking bar that is received in a notch in the socket flange to prevent rotation between the clip and the socket. The radial positions of the injector rib and flange notch are selected such that the injector, when assembled to the fuel rail socket, is properly oriented with respect to the engine requirements. The combination of the tangs and rib, and of the windows, bar, and notch, is sufficiently robust to withstand an imposed torque of at least 3 Nm between the fuel injector and the fuel rail socket.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
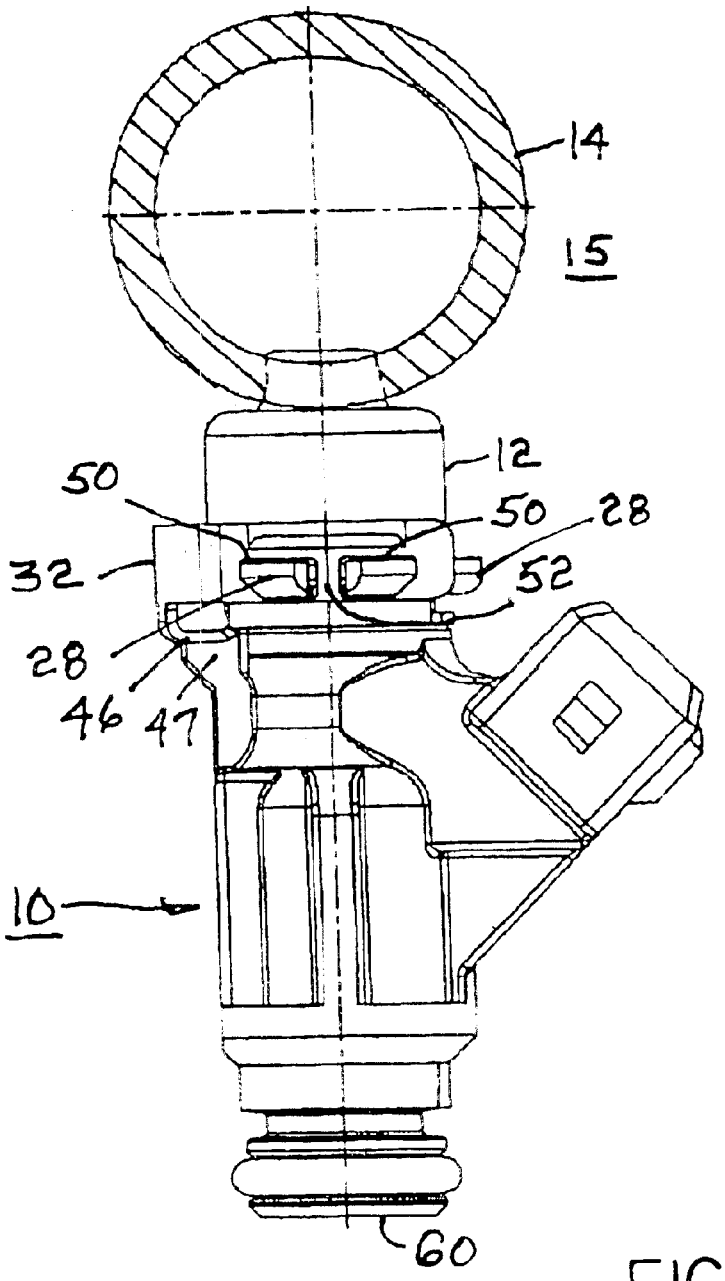
FIG. 1 is an elevational view, partly in cross-section, of a fuel injector attached to a socket in a fuel rail by an anti-rotation clip in accordance with the invention.
Figure 2:
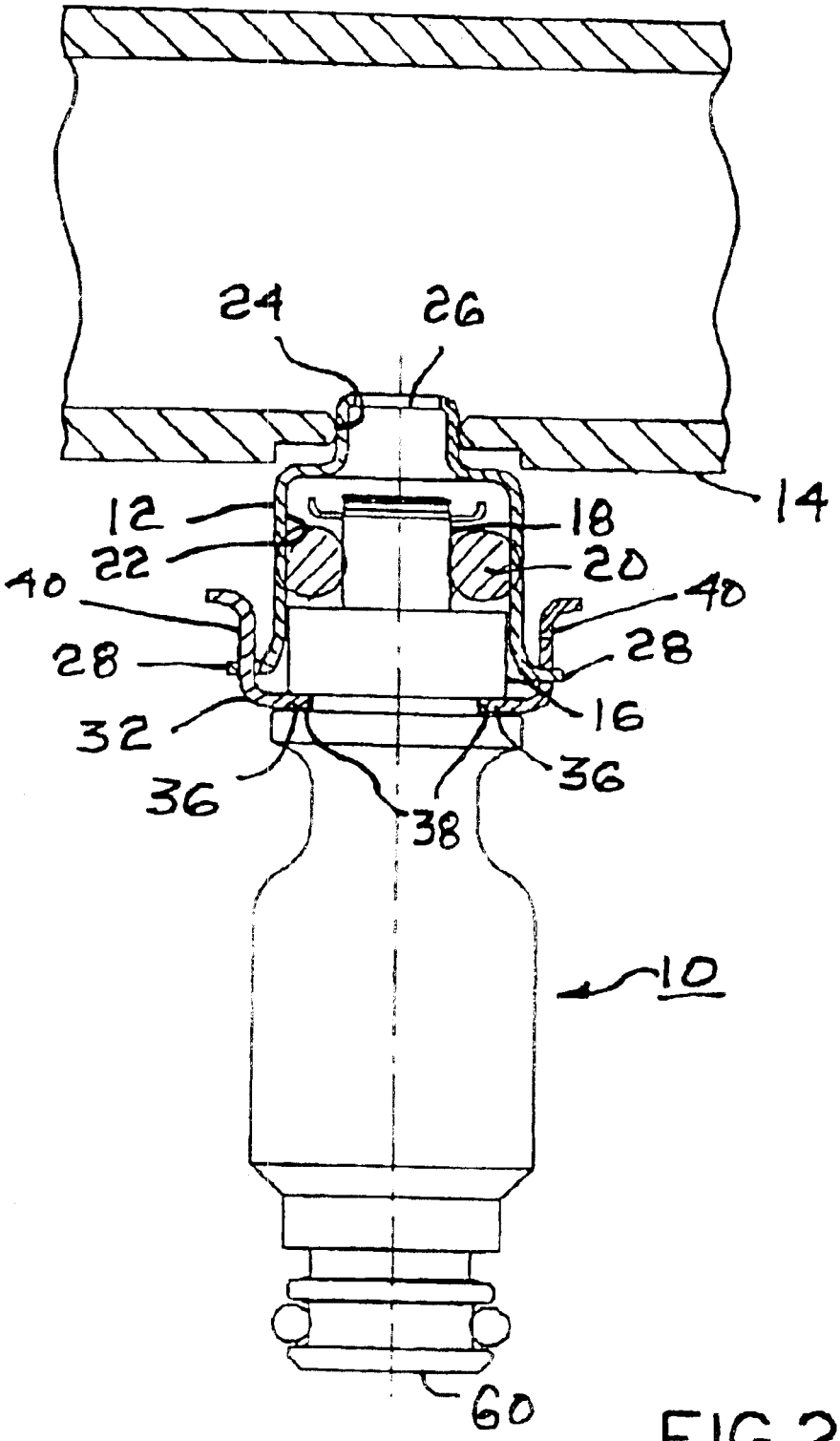
FIG. 2 is a simplified elevational view like that shown in FIG. 1 but turned 900, showing details of attachment of the clip to the fuel injector and the fuel rail socket.
Figure 3:
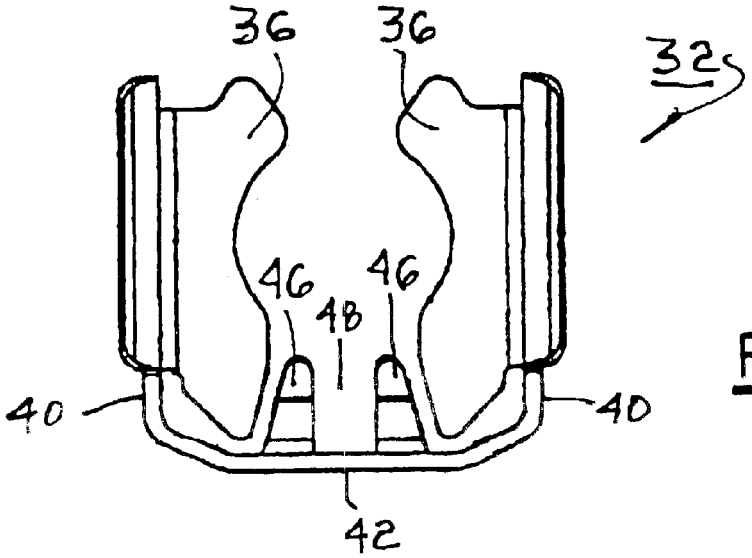
FIG. 3 is a plan view of an anti-rotation clip in accordance with the invention.
Figure 4:
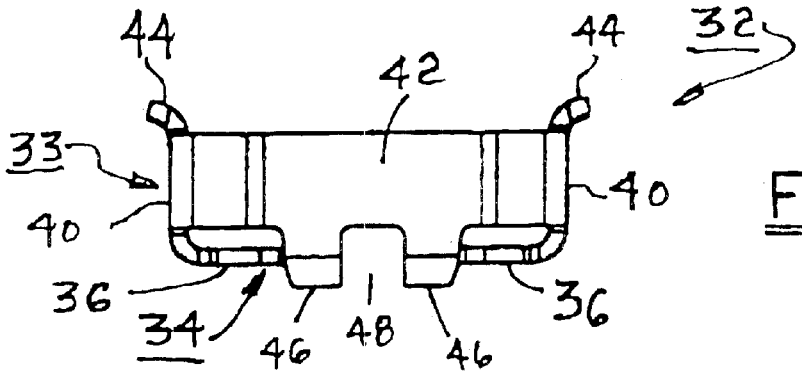
FIG. 4 is an end elevational view of the clip shown in FIG. 3.
Figure 5:
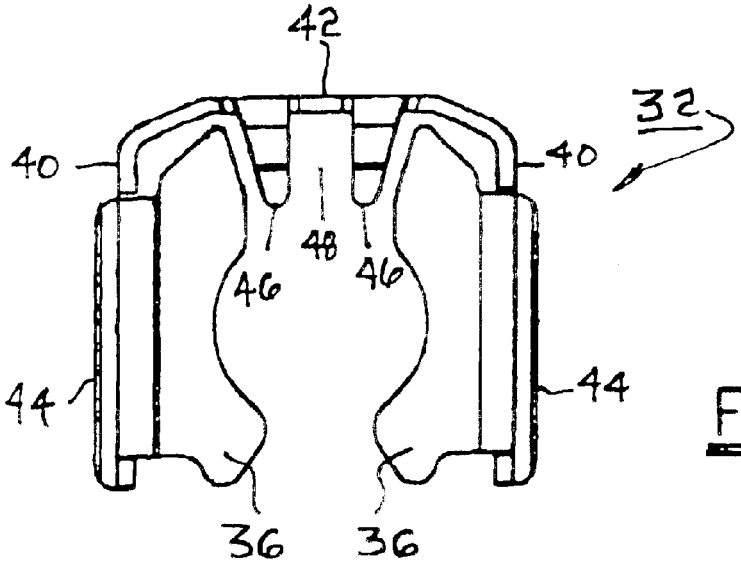
FIG. 5 is a bottom view of the clip shown in FIG. 3.
Figure 6:
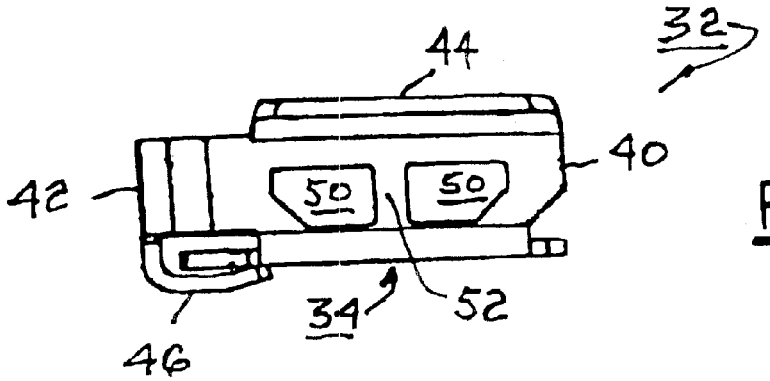
FIG. 6 is a side elevational view of the clip shown in FIG. 3.
Figure 7:
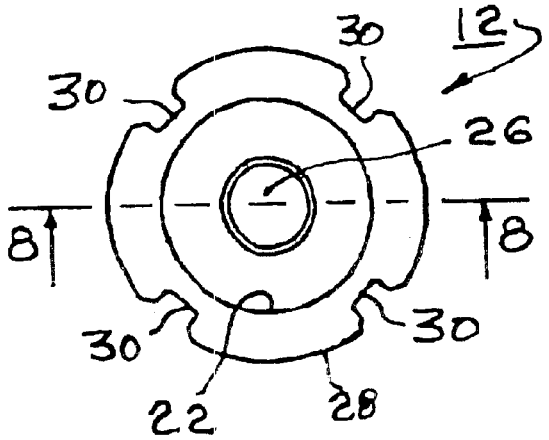
FIG. 7 is a plan view of the fuel rail socket shown in FIGS. 1 and 2.
Figure 8:
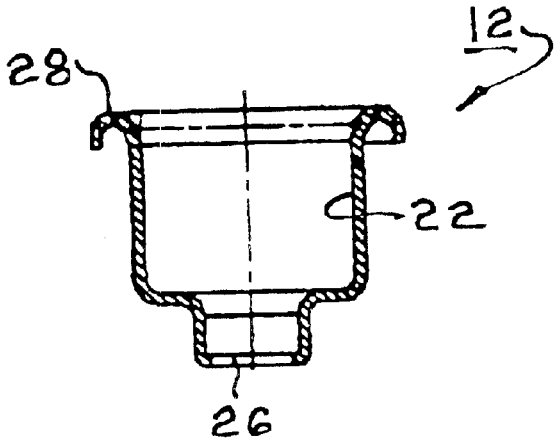
FIG. 8 is a cross-sectional view of the socket taken along line 8—8 in FIG. 7.

Referring to FIGS. 1, 2, 7, and 8, a conventional fuel injector 10 is coupled into a socket 12 of a fuel rail 14 of an internal combustion engine 15. A first necked portion 16 and second necked portion 18 of injector 10 supporting an O-ring 20 extend into socket 12 forming a fuel-tight seal against the inner surface 22 thereof. Socket 12 itself is brazed or welded into a port 24 in the wall of fuel rail 14. A central opening 26 in socket 12 allows fuel to flow as required from fuel rail 14 into injector 10. Socket 12 has an outer flange 28 that is preferably slightly flared or rolled outwards, as shown in FIG. 8, to help in guiding injector 10 into mating relationship. Flange 28 is provided with one or more notches 30 extending through the outer part of the flange for engaging anti-rotation means as described below.

Referring now additionally to FIGS. 3 through 6, an anti-rotation clip 32 in accordance with the invention is provided for securing injector 10 into socket 12 in fixed axial and rotational relationship. Clip 32 is preferably and economically stamped and folded from sheet metal stock in known fashion. Clip 32 has a generally U-shaped body 33 including a base portion 34 defining a pair of opposed claspers 36 formed to engage and retain injector 10 therebetween upon insertion into an annular groove 38 in the body of injector 10. Claspers 36 extend from opposed sidewalls 40 connected by a third sidewall 42 defining a resilient member for permitting the claspers 36 and sidewalls 40 to move apart as clip 32 is installed into groove 38 and then spring back to engage and retain injector 10. Preferably, sidewalls 40 have edges 44 rolled outwards to help guide socket flange 28 into the clip during mating with the socket.

Extending from third sidewall 42 is a pair of tangs 46, curved inwards of the clip and spaced apart by a gap 48.

At least one, and preferably both, of opposed sidewalls 40 includes a pair of openings 50, referred to in the art as "windows," separated by a locking bar 52. The windows and bar preferably are formed as by stamping. The width of bar 52 is selected to allow bar 52 to fit into one of notches 30 during assembly of the fuel injector into the socket.

An important advantage of an anti-rotation clip 32 in accordance with the invention, in comparison with, for example, a prior art anti-rotation clip as disclosed in U.S. Pat. No. 5,803,052 and discussed above, is the capability for assembly of the clip to either the fuel injector or the socket prior to joining of the fuel injector into the socket. The radial insertion of the injector onto the clip and the axial insertion of the socket onto the clip are independent of one another and may be performed in either order.

For example, in an assembly method in accordance with the invention, clip 32 is installed onto injector 10 by being snapped into groove 38 wherein claspers 36 resiliently grip the injector to fix the axial relationship between injector 10 and clip 32. Tangs 46 straddle a longitudinal rib 47 (FIG. 1) which fits into gap 48 to fix the rotational relationship between injector 10 and clip 32. The injector/clip sub-assembly is then rotated to a predetermined correct azimuthal relationship with socket 12 and is advanced axially onto and into socket 12 of a socket/fuel rail sub-assembly (socket 12 is attached into rail port 24 in a predetermined rotational orientation with respect to the axis of the fuel rail such that notches 30 are properly positioned for eventual correct fixed orientation of injector 12). Flange 28 engages flared edges 44 of opposed walls 40, forcing them apart and preloading a flexural spring defined by third wall 42. Advancement of the injector/clip sub-assembly is continued until flange 28 reaches openings 50, whereupon rolled portions of flange 28 extend through and are captured by openings 50 and each locking bar 52 is received in a notch 30 as third wall 42 is relieved. The axial and rotational orientation of the injector/clip sub-assembly is now fixed with respect to the socket/fuel rail sub-assembly; thus the injector tip 60 will be properly and durably oriented within engine 15 when the fuel rail and injector sub-assembly is attached thereto.

It is an important improvement of the present invention that locking bar 52 is connected to the clip at both of its ends, providing great strength against imposed rotational torque. In the somewhat similar prior art clip disclosed in U.S. Pat. No. 6,481,420 and discussed above, the alignment protrusion 58 is supported at only one end and therefore is vulnerable to being twisted out of position by rotational forces.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A clip for connecting a fuel injector into a socket of a fuel rail for an internal combustion engine, comprising:

a) at least one first sidewall, having at least two windows separated by a locking bar for engaging said socket;

b) a flexibly resilient second sidewall adjacent said at least one first sidewall;

c) at least one clasper for engaging and receiving said fuel injector in a radial direction; and d) means for preventing rotation of said fuel injector.

2. A clip in accordance with claim 1 wherein said at least one clasper includes a pair of opposed claspers.

3. A clip in accordance with claim 1 wherein said locking bar is connected at both ends to said at least one sidewall.

4. A clip in accordance with claim 1 wherein said fuel injector includes a rib on an outer surface thereof, and wherein said means for preventing includes a pair of tangs for straddling said rib.

5. A clip in accordance with claim 1 wherein said at least one first sidewall comprises a pair of opposing sidewalls, said pair of opposing sidewalls each having at least two windows separated by a locking bar for engaging said socket.

6. A system for assuring a predetermined angular relationship between a fuel injector and a fuel rail for an internal combustion engine by preventing relative rotation therebetween, comprising:

a) a fuel injector having an annular groove in an outer surface thereof and a rib element formed on said outer surface;

b) a cup-shaped socket in said fuel rail having a flange, said flange having at least one notch, said socket being receivable of an end of said fuel injector; and c) a clip for connecting said fuel injector into said socket, said clip having at least one first sidewall, said at least one first sidewall having at least two windows separated by a locking bar for engaging said socket notch, a flexibly resilient second sidewall adjacent said at least one first sidewall, at least one clasper for engaging and receiving said fuel injector in a radial direction, and means for preventing rotation of said fuel injector.

7. A fuel-injected internal combustion engine, comprising a system for assuring a predetermined angular relationship between a fuel injector and a fuel rail by preventing relative rotation therebetween, said system including, a fuel injector having an annular groove in an outer surface thereof and a rib element formed on said outer surface, a cup-shaped socket in said fuel rail having a flange, said flange having at least one notch, said socket being receivable of an end of said fuel injector; and a clip for connecting said fuel injector into said socket, said clip having at least one first sidewall, said at least one first sidewall having at least two windows separated by a locking bar for engaging said socket notch, a flexibly resilient second sidewall adjacent said at least one first sidewall, at least one clasper for engaging and receiving said fuel injector in a radial direction, and means for preventing rotation of said fuel injector.

* * * * *